US012351983B2

(12) United States Patent
Ankeny et al.

(10) Patent No.: US 12,351,983 B2
(45) Date of Patent: Jul. 8, 2025

(54) PRETREATMENT METHODS FOR COTTON TEXTILE WASTE FABRIC

(71) Applicants: NORTH CAROLINA STATE UNIVERSITY, Raleigh, NC (US); Cotton Incorporated, Cary, NC (US)

(72) Inventors: Mary Ann Ankeny, Raleigh, NC (US); Matthew J. Farrell, Apex, NC (US); Ronalds Gonzalez, Apex, NC (US); Hasan Jameel, Raleigh, NC (US)

(73) Assignees: NORTH CAROLINA STATE UNIVERSITY, Raleigh, NC (US); Cotton Incorporated, Cary, NC (US)

( * ) Notice: Subject to any disclaimer, the term of this patent is extended or adjusted under 35 U.S.C. 154(b) by 267 days.

(21) Appl. No.: 18/062,384

(22) Filed: Dec. 6, 2022

(65) Prior Publication Data

US 2023/0175205 A1 Jun. 8, 2023

Related U.S. Application Data

(60) Provisional application No. 63/287,355, filed on Dec. 8, 2021.

(51) Int. Cl.

| | |
|---|---|
| ***D21D 1/34*** | (2006.01) |
| ***D21B 1/14*** | (2006.01) |
| ***D21D 1/40*** | (2006.01) |
| ***D21H 17/67*** | (2006.01) |

(52) U.S. Cl.
CPC ..... *D21D 1/34* (2013.01); *D21B 1/14* (2013.01); *D21D 1/40* (2013.01); *D21H 17/67* (2013.01)

(58) Field of Classification Search
CPC ..... D21C 1/04; D21C 5/00; D21C 5/005; D21H 17/67; D21D 1/34; D21D 1/40; D21B 1/14
See application file for complete search history.

(56) References Cited

U.S. PATENT DOCUMENTS

| | | | | |
|---|---|---|---|---|
| 4,978,364 | A | 12/1990 | Walker | |
| 6,066,494 | A | 5/2000 | Hsieh | |
| 7,771,565 | B2 | 8/2010 | Kirov | |
| 11,421,257 | B2 | 8/2022 | Farrell et al. | |
| 2009/0044345 | A1 * | 2/2009 | Schlingloff ..... | A61L 12/128 8/111 |
| 2016/0160253 | A1 | 6/2016 | Larsen | |

(Continued)

FOREIGN PATENT DOCUMENTS

| | | | |
|---|---|---|---|
| WO | 2021003077 | A1 | 1/2021 |
| WO | WO-2021226094 | A1 * | 11/2021 |
| WO | 2023107947 | A1 | 6/2023 |

OTHER PUBLICATIONS

International Search Report for PCT/US2022/081020, mailed Jun. 15, 2023.

(Continued)

*Primary Examiner* — Jacob T Minskey
*Assistant Examiner* — Elisa H Vera
(74) *Attorney, Agent, or Firm* — McBee Moore & Vanik IP, LLC

(57) ABSTRACT

Disclosed is mechanical and decolorization pretreatment of cotton-containing textiles, such as "trash" feedstock in terms of end-of-life-cotton textiles, that may be used to produce sugar without the use of harsh pretreatments conditions.

28 Claims, 4 Drawing Sheets

(56) References Cited

U.S. PATENT DOCUMENTS

2016/0201102 A1 7/2016 Zhu et al.
2021/0269969 A1* 9/2021 Brelid ..... B29B 17/0412

OTHER PUBLICATIONS

Written Opinion for PCT/US2022/081020, mailed Jun. 15, 2023.
Wyman et al., "Simultaneous Saccharification and Fermentation of Several Lignocellulosic Feedstocks to Fuel Ethanol," Biomass and Bioenergy, 1992, 3(5): 301-307.
"Laboratory beating of pulp (PFI mill method)," approved by the Pulp Properties Committee of the Process and Product Quality Division, TAPPI, 2000, pp. 1-6.
"Textiles: Material-Specific Data," retrieved from <https://epa.gov/facts-and-figures-about-materials-waste-and-recycling/textiles-material-specific-data> on Oct. 7, 2021, pp. 1-5.
Beall, "Why are clothes so hard to recycle," Jul. 12, 2020, British Broadcasting Corporation website, pp. 1-10.
Li et al., "Biodegradability study on cotton and polyester fabrics," J. Eng. Fiber. Fabr., vol. 5, No. 4, pp. 42-53, 2010.
Singh and Satapathy, "Conversion of Lignocellulosic Biomass to Bioethanol: An Overview with a Focus on Pretreatment," Int. J. Eng. Technol., vol. 15, pp. 17-43, 2018.
Rojas (ed.), "Cellulose Chemistry and Properties : Fibers, Nanocelluloses and Advanced Materials," (book), Springer, New York, 2016, ISSN: 0065-3195.
Hamawand et al., "Bioenergy from Cotton Industry Wastes: A review and potential," Renew. Sustain. Energy Rev., vol. 66, pp. 435-448, 2016.
Johnson et al. "Supply Chain of Waste Cotton Recycling and Reuse : A Review," AATCC Journal of Research, 2020, 7(1):19-31, abstract only.
Alvira et al. "Pretreatment technologies for an efficient bioethanol production process based on enzymatic hydrolysis: A review," Bioresour. Technol., 2010, 101(13): 4851-4861.
Abbati De Assis et al., "Risk management consideration in the bioeconomy," Biofuels, Bioprod. Biorefining, 2017, 11: 549-566, abstract only.
Chandra et al., "Substrate pretreatment: The key to effective enzymatic hydrolysis of lignocellulosics?," Adv. Biochem. Eng. Biotechnol., 2007, 108: 67-93.
Bajpai, "Pretreatment of Lignocellulosic Biomass," Springer, Singapore, 2016, Chapter 4, pp. 17-70.
Heinze et al, Cellulose Chemistry and Properties : Fibers , Nanocelluloses and Advanced Materials, vol. 271. Springer International Publishing, 2016 (book): 1-52.
Hendricks et al., "Pretreatments to enhance the digestibility of lignocellulosic biomass," Bioresour. Technol., 100(1): 10-18, Jan. 2009.
Corbett et al., "Fiber fractionation to understand the effect of mechanical refining on fiber structure and resulting enzymatic digestibility of biomass," Biotechnol. Bioeng.,2020, 117: 924-932.
De Assis et al., "Toward an understanding of the increase in enzymatic hydrolysis by mechanical refining," 2018, Biotechnol. Biofuels, vol. 11, pp. 1-11.
Gharehkani et al., "Basic effects of pulp refining on fiber properties—A review," 2015, Carbohydr. Polym. , El Seiver, 115: pp. 1-5.
Buschle-Diller & Traore, "Influence of direct and reactive dyes on the enzymatic hydrolysis of cotton," Textile Research Journal, 1998, 68(3): 185-192.
Chakraborty et al., Modeling energy consumption for the generation of microfibres from bleached kraft pulp fibres in a PFI mill, BioResources, 2007, pp. 210-222, vol. 2-2.

* cited by examiner

PRETREATMENT METHODS FOR COTTON TEXTILE WASTE FABRIC

CROSS-REFERENCE TO RELATED APPLICATIONS

This application claims priority to U.S. Application No. 63/287,355, filed 8 Dec. 2021, the disclosure of which is herein incorporated by reference in its entirety.

FIELD OF THE INVENTION

This disclosure relates to a process for producing sugar from cotton-containing textiles.

BACKGROUND OF THE INVENTION

The Environmental Protection Agency (EPA) estimates that the United States in 2018 combusted 3.2 million tons of textile waste and landfills receives 11.3 million tones of textile waste. EPA "Textiles: Material-Specific Data" EPA Website (2021). If discarded in a landfill, these textiles contribute to the emission of greenhouse gases (e.g., methane) as they degrade. Further, the degradation process for synthetic fibers (e.g., polyesters) can take hundreds of years. If the textile waste is incinerated, toxic gases can be released, especially from more complex textile blends. BBC Website "Why Clothes are so hard to recycle." (Jul. 12, 2020).

Textile waste represents 3% of the global waste market share. Hamawand et al., "Bioenergy from Cotton Industry Wastes: A review and potential," *Renew. Sustain. Energy Rev.*, vol. 66, pp. 435-448, 2016; Johnson et al. "Supply Chain of Waste Cotton Recycling and Reuse: A Review," 2020. It is the 10th most generated waste after food, paper, plastic, and glass derived waste. Degradation time for cotton fabric is approximately 50-77% in 90 days. Li, Frey, and Browning, "Biodegradability study on cotton and polyester fabrics," *J. Eng. Fiber. Fabr.*, vol. 5, no. 4, pp. 42-53, 2010.

There exists a need in the art for methods for processing textile waste into sugar and other value-added products.

SUMMARY OF THE INVENTION

In an embodiment, a method of pretreating cotton-containing textile material may comprise refining the cotton-containing textile material in a PFI mill for between about 2,000 and 20,000 revolutions.

In an embodiment, a method of pretreating cotton-containing textile material may comprise decolorizing the cotton-containing textile material and refining the cotton-containing textile material in a PFI mill for between about 2,000 and 20,000 revolutions.

The method may further comprise additional pretreatment. The additional pretreatment may comprise mechanical pretreatment, chemical, enzymatic pretreatment, or a combination thereof. The method may further comprise shredding the cotton-containing textile material, cutting the cotton-containing textile material, and milling the cotton-containing textile material prior to refining the cotton-containing textile material in PFI mill.

In an embodiment, a method of processing cotton-containing textile material may comprise (a) shredding the cotton-containing textile material; (b) cutting the cotton-containing textile material; (c) milling the cotton-containing textile material; (d) refining the cotton-containing textile material in a PFI mill for between about 2,000 and 20,000 revolutions; and (e) subjecting the pretreated cotton-containing textile material to hydrolysis to produce a hydrolysate. In an embodiment, the method may further comprise decolorizing the cotton-containing textile material after cutting and milling, but before refining.

In an embodiment, method of processing cotton-containing textile material may comprise (a) shredding the cotton-containing textile material; (b) cutting the cotton-containing textile material; (c) milling the cotton-containing textile material; (d) decolorizing the cotton-containing textile material; (e) refining the cotton-containing textile material in a PFI mill for between about 2,000 and 20,000 revolutions; and (f) subjecting the pretreated cotton-containing textile material to hydrolysis to produce a hydrolysate.

In an embodiment, the decolorizing step may comprise bleaching. The bleaching may comprise treatment with ozone, sodium hypochlorite, hydrogen peroxide, a Fenton's reagent, or a combination thereof. The hydrogen peroxide may be in a range from about 1.0% to about 8.0% (w/w). The hydrogen peroxide may be in the range of about 2.0% to 6.0%, 4.0% and 8.0%, 5.0% and 7% (w/w).

In an embodiment, the bleaching may further comprise treatment with sodium hydroxide. The sodium hydroxide may be in a range from 1.0% to about 6.0%, or optionally in a range from 2.0% to 4.0% (w/w). The sodium hydroxide may be in the range of from about 2.0% to 4.0%, 3.0% to 5.0%, 4.0% to 6.0%, or 1.0% to 5.0% (w/w). The sodium hydroxide may be in an amount of about 1.0%, 2.0%, 3.0%, 4.0%, 5.0%, or 6.0% (w/w).

In an embodiment, the method may further comprise adding $Cu^{2+}$. The $Cu^{2+}$ may be added in the range of 100 ppm to 250 ppm. The range may be from about 120 ppm to 170 ppm. The amount may be about 100 ppm, 101 ppm, 102 ppm, 103 ppm, 104 ppm, 105 ppm, 106 ppm, 107 ppm, 108 ppm, 109 ppm, 110 ppm, 111 ppm, 112 ppm, 113 ppm, 114 ppm, 115 ppm, 116 ppm, 117 ppm, 118 ppm, 119 ppm, 120 ppm, 121 ppm, 122 ppm, 123 ppm, 124 ppm, 125 ppm, 126 ppm, 127 ppm, 128 ppm, 129 ppm, 130 ppm, 131 ppm, 132 ppm, 133 ppm, 134 ppm, 135 ppm, 136 ppm, 137 ppm, 138 ppm, 139 ppm, 140 ppm, 141 ppm, 142 ppm, 143 ppm, 144 ppm, 145 ppm, 146 ppm, 147 ppm, 148 ppm, 149 ppm, 150 ppm, 151 ppm, 152 ppm, 153 ppm, 154 ppm, 155 ppm, 156 ppm, 157 ppm, 158 ppm, 159 ppm, 160 ppm, 161 ppm, 162 ppm, 163 ppm, 164 ppm, 165 ppm, 166 ppm, 167 ppm, 168 ppm, 169 ppm, 170 ppm, 171 ppm, 172 ppm, 173 ppm, 174 ppm, 175 ppm, 176 ppm, 177 ppm, 178 ppm, 179 ppm, 180 ppm, 181 ppm, 182 ppm, 183 ppm, 184 ppm, 185 ppm, 186 ppm, 187 ppm, 188 ppm, 189 ppm, 190 ppm, 191 ppm, 192 ppm, 193 ppm, 194 ppm, 195 ppm, 196 ppm, 197 ppm, 198 ppm, 199 ppm, 200 ppm, 201 ppm, 202 ppm, 203 ppm, 204 ppm, 205 ppm, 206 ppm, 207 ppm, 208 ppm, 209 ppm, 210 ppm, 215 ppm, 220 ppm, 225, 230 ppm, 235 ppm, 240 ppm, 245 ppm, or 250 ppm.

In an embodiment, the method may further comprise adding $Fe^{2+}$. The $Fe^{2+}$ may be added in the range of 100 ppm to 250 ppm. The range may be from about 120 ppm to 170 ppm. The amount may be about 100 ppm, 101 ppm, 102 ppm, 103 ppm, 104 ppm, 105 ppm, 106 ppm, 107 ppm, 108 ppm, 109 ppm, 110 ppm, 111 ppm, 112 ppm, 113 ppm, 114 ppm, 115 ppm, 116 ppm, 117 ppm, 118 ppm, 119 ppm, 120 ppm, 121 ppm, 122 ppm, 123 ppm, 124 ppm, 125 ppm, 126 ppm, 127 ppm, 128 ppm, 129 ppm, 130 ppm, 131 ppm, 132 ppm, 133 ppm, 134 ppm, 135 ppm, 136 ppm, 137 ppm, 138 ppm, 139 ppm, 140 ppm, 141 ppm, 142 ppm, 143 ppm, 144 ppm, 145 ppm, 146 ppm, 147 ppm, 148 ppm, 149 ppm, 150 ppm, 151 ppm, 152 ppm, 153 ppm, 154 ppm, 155 ppm, 156 ppm, 157 ppm, 158 ppm, 159 ppm, 160 ppm, 161 ppm, 162 ppm, 163 ppm, 164 ppm, 165 ppm, 166 ppm, 167 ppm, 168 ppm, 169 ppm, 170 ppm, 171 ppm, 172 ppm, 173 ppm, 174 ppm, 175 ppm, 176 ppm, 177 ppm, 178 ppm, 179 ppm, 180 ppm, 181 ppm, 182 ppm, 183 ppm, 184 ppm, 185 ppm, 186 ppm, 187 ppm, 188 ppm, 189 ppm, 190 ppm, 191 ppm, 192 ppm, 193 ppm, 194 ppm, 195 ppm, 196 ppm, 197 ppm, 198 ppm, 199 ppm, 200 ppm, 201 ppm, 202 ppm, 203 ppm, 204 ppm, 205 ppm, 206 ppm, 207 ppm, 208 ppm, 209 ppm, 210 ppm, 215 ppm, 220 ppm, 225, 230 ppm, 235 ppm, 240 ppm, 245 ppm, or 250 ppm.

In an embodiment, the bleaching may be conducted at a temperature range of 60° C. to 120° C. The temperature may be in a range of about 80° C. to 100° C. The bleaching may be conducted at a temperature of between about 100° C. to 110° C., 90° C. to 100° C., 90° C. to 110° C., or 95° C. to 120° C. The temperature may be about 80° C., 81° C., 82° C., 83° C., 84° C., 85° C., 86° C., 87° C., 88° C., 89° C., 90° C., 91° C., 92° C., 93° C., 94° C., 95° C., 96° C., 97° C., 98° C., 99° C., 100° C., 101° C., 102° C., 103° C., 104° C., 105° C., 106° C., 107° C., 108° C., 109° C., 110° C., 111° C., 112° C., 113° C., 114° C., 115° C., 116° C., 117° C., 118° C., 119° C., or 120° C.

In an embodiment, the bleaching may be conducted for a time in the range of 60 minutes to 120 minutes. The time may be in the range of about 80 minutes to 110 minutes. The time may be in the range of about 80 to 90 minutes, 90 to 100 minutes, 95 to 120 minutes, or 110 to 120 minutes. The time may be about 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, or 120 minutes.

In an embodiment, the decolorization may be performed at a pH between about pH 7 and pH 11. The decolorization may be performed at a pH above pH 10. The decolorization may be performed at about pH 11. The decolorization may be performed at about pH 11.5. The decolorization may be performed at about pH 11.75. The decolorization may be performed at about pH 12.

In an embodiment, a solvent may be added to the cotton-containing textile material prior to refining in a PFI mill. The solvent may be water.

In an embodiment, the method may further comprise enzymatic hydrolysis of the pretreated cotton-containing textile material to produce a hydrolysate.

In an embodiment, the method may further comprise cutting the cotton-containing textile material.

In an embodiment, the method may further comprise milling the cotton-containing textile material.

In an embodiment, the method may further comprise decolorizing the cotton-containing textile material.

In an embodiment, the mechanical pretreatment may comprise shredding, cutting, milling, refining, and combinations thereof.

In an embodiment, the method may further comprise adding a solvent to the cotton-containing textile material during the mechanical pretreatment. The solvent may be water. The solvent may be added before, during, or both before and during refining. The solvent may be added in an amount of between about 1:0.01 and 1:30 mechanically pretreated cotton-containing textile:solvent weight/weight. The amount of solvent added to the cotton-containing textile may be between about 1:0.1 and 1:20, 1:0.1 and 1:10, 1:0.1 and 1:5, or 1:0.1 and 1:0.5 mechanically pretreated cotton-containing textile:solvent weight/weight. The amount of solvent added to the cotton-containing textile may be about 1:0.1, 1:0.2, 1:0.3; 1:0.4. 1:0.5, 1:0.6, 1:0.7, 1:0.8, 1:0.9, or 1:1 mechanically pretreated cotton-containing textile:solvent weight/weight. The amount of solvent added to the cotton-containing textile may be 1:0.2 mechanically pretreated cotton-containing textile:solvent weight/weight.

In an embodiment, the mechanical pretreatment may be conducted at a temperature between about 0° C. and 50° C. The mechanical pretreatment may be conducted at a temperature between about 10° C. and 40° C. The mechanical pretreatment may be conducted at a temperature of about 10° C., 11° C., 12° C., 13° C., 14° C., 15° C., 16° C., 17° C., 18° C., 19° C., 20° C., 21° C., 22° C., 23° C., 24° C., 25° C., 26° C., 27° C., 28° C., 29° C., 30° C., 30° C., 31° C., 32° C., 33° C., 34° C., 35° C., 36° C., 37° C., 38° C., 39° C., or 40° C. The mechanical pretreatment may be conducted at a temperature of about 25° C.

In an embodiment, the mechanically pretreated cotton-containing textile material may comprise between about 1% and 50% fines by weight. The mechanically pretreated cotton-containing textile material may comprise between about 1% and 20% fines by weight, 25% and 50% fines by weight, 10% and 30% fines by weight, 30% and 50% fines by weight, or 15% and 35% fines by weight. The mechanically pretreated cotton-containing textile material may comprise between about 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, or 50% fines by weight In an embodiment, the fiber length LWL (mm) of the mechanically pretreated cotton-containing textile material may be between about 0.1 mm and 2.00 mm. The fiber length LWL (mm) of the mechanically pretreated cotton-containing textile material may be between about 0.1 mm, 0.2 mm, 0.3 mm, 0.4 mm, 0.5 mm, 0.6 mm, 0.7 mm, 0.8 mm, 0.9 mm, 1.0 mm, 1.1 mm, 1.2 mm, 1.3 mm, 1.4 mm, 1.5 mm, 1.6 mm, 1.7 mm, 1.8 mm, 1.9 mm, or 2.00 mm.

In an embodiment, the level of refining may be between about 2,000 and 20,000 PFI revs. The level of refining may be between about 2,000 and 10,000 PFI revs; 5,000 and 15,00 PFI revs; 5,000 and 20,000 PFI revs; or 10,000 and 20,000 PFI revs. The level of refining may be at about 2,000; 3,000; 4,000, 5,000; 6,000; 7,000; 8,000; 9,000; 10,000; 11,000; 12,000; 13,000; 14,000, 15,000; 16,000; 17,000; 18,000; 19,000; or 20,000 PFI revs.

In an embodiment, the Canadian Standard Freeness (CSF) of mechanically pretreated cotton-containing textile material may be between about 100 and 900 CSF milliliters. The Canadian Standard Freeness (CSF) of mechanically pretreated cotton-containing textile material may be between about 100 and 900 CSF milliliters, 200 and 400 CSF milliliters, 400 and 600 CSF milliliters. The level of refining may be between about 100 and 900 ml CSF milliliters.

In an embodiment, the mechanically pretreated cotton-containing textile may be in the form of a powder. The average particle size of the powder may be between about 0.10 mm and about 2.0 mm.

In an embodiment, a Wiley Mill may be used for the cutting step.

In an embodiment, the mechanical pretreatment may be performed before decolorization of the cotton-textile material.

In an embodiment, the hydrolysis may comprise enzyme hydrolysis comprising the addition of at least one hydrolytic enzyme.

In an embodiment, the enzymatic hydrolysis may comprise the addition combination of a cellulase and β-glucosidase.

In an embodiment, the hydrolysate may comprise a sugar. The sugar may be glucan, xylan, arabinan, mannan, galactan, glucose, sucrose, hexose, or a combination thereof.

In an embodiment, the enzymatic hydrolysis may be conducted at a temperature between about 20° C. and 75° C. The enzymatic hydrolysis may be conducted at a temperature between about 40° C. and 75° C., about 45° C. and 75° C., 50° C. and 75° C., about 55° C. and 75° C., 60° C. and 75° C., or about 65° C. and 75° C. The enzymatic hydrolysis may be conducted at 20° C., 25° C., 30° C., 35° C., 40° C., 45° C., 50° C., 55° C., 60° C., 65° C., 70° C., or 75° C.

In an embodiment, the enzymatic hydrolysis may be conducted at a pH between about pH=4.5 and pH=8.5. The enzymatic hydrolysis may be conducted at a pH of 4.5, 4.6, 4.7, 4.8, 4.9, 5, 5.1, 5.2, 5.3, 5.4, 5.5, 5.6, 5.7, 5.8, 5.9, 6, 6.1, 6.2, 6.3, 6.4, 6.5, 6.6, 6.7, 6.8, 6.9, 7, 7.1, 7.2, 7.3, 7.4, 7.5, 7.6, 7.7, 7.8, 7.9, 8, 8.1, 8.2, 8.3, 8.4, or 8.5.

In an embodiment, the enzymatic hydrolysis may be conducted for between about 1 hour and 300 hours. The enzymatic hydrolysis may be conducted for between about 12 hours and 300 hours, 24 hours and 144 hours, 24 hours and 180 hours, 48 hours and 240 hours, or 24 hours and 96 hours. The enzymatic hydrolysis may be conducted for about 12, 24, 36, 48, 60, 72, 84, 96, 108, 120, 132, 144, 156, 168, 180, 192, 204, 216, 228, 240, 252, 264, 276, 288, or 300 hours. The enzymatic hydrolysis may be conducted for about 24, 36, 48, 60, 72, 84, 96, 108, 120, 132, 144, 156, 168, 180, or 192 hours.

In an embodiment, the amount of enzyme used in the enzymatic hydrolysis may be between about 1 FPU and 50 FPU/g cotton. The amount of enzyme used in the enzymatic hydrolysis may be about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 FPU.

In an embodiment, the amount of enzyme used in the enzymatic hydrolysis may be between about 0.01% and 10% enzyme/cotton (w/w), optionally between about 0.02% to 0.05% enzyme/cotton (w/w).

In an embodiment, the enzymatic hydrolysis efficiency may be at least 50%, at least 60%, at least 65%, or at least 70%.

In an embodiment, the enzymatic hydrolysis may further comprise the addition of an acid, base, or both for pH control. The acid may be acetic acid, citric acid, or a combination thereof.

In an embodiment, the method may further comprise filtering the hydrolysis product to produce a permeate and retentate, wherein the permeate may comprise the hydrolysate and the retentate may comprise the residue.

In an embodiment, the method may further comprise subjecting the hydrolysate to fermentation, oxidation, reduction, or hydrogenation to produce an end product.

In an embodiment, the method may further comprise subjecting the hydrolysate to fermentation.

In an embodiment, the end products produced by fermentation comprise alcohols, sugar alcohols, acids, fatty acids, gases, amino acids, chemicals, and mixtures thereof. The sugar alcohols may comprise sorbitol, xylitol, ethylene glycol, glycerol, erythritol, threitol, arabitol, ribitol, mannitol, galactitol, fucitol, iditol, inositol, volemitol, isomalt, lactitol, and mixtures thereof. The alcohols may comprise ethanol, butanol, methanol, propanol, and mixtures thereof. The acids may comprise 2,5-furandicarboxylic acid, itaconic acid, levulinic acid, succinic acid, lactic acid, malic acid, citric acid, acrylic acid, fumaric acid, hydroxypropionic acid, acrylic acid, and mixtures thereof. The chemicals may comprise glycerol, 3-hydropropoionic acid, 2,5-dimethylfuran (DMF), 5-hydroxymethyl furfural (HMF), furfural, aldehydes, amines, terephthalic acid, hexamethylenediamine, isoprene, polyhydroxyalkanoates, 1,3-propanediol, or mixtures thereof. The gases may comprise methane, ethane, CO, $CO_2$, and $H_2$, or mixtures thereof.

In an embodiment, the enzymatic hydrolysis and fermentation may occur simultaneously.

In an embodiment, the enzymatic hydrolysis and fermentation may be conducted separately.

In an embodiment, the method may not comprise a pretreatment step that requires neutralization from use of an acid or base, recovery of any solvent, or rinsing steps necessitated from a pretreatment that requires components to be removed before hydrolysis and/or fermentation.

In an embodiment, a method may not comprise a step that requires the use of an acid.

In an embodiment, mechanical pretreatment may be substantially free of the use of chemicals.

In an embodiment, a system for the production of sugars from a cotton-containing textile material may comprise a shredding means, cutting means, milling means, refining means, and an enzymatic hydrolysis reactor all mechanically coupled together in series.

DETAILED DESCRIPTION OF THE INVENTION

Figure 1:
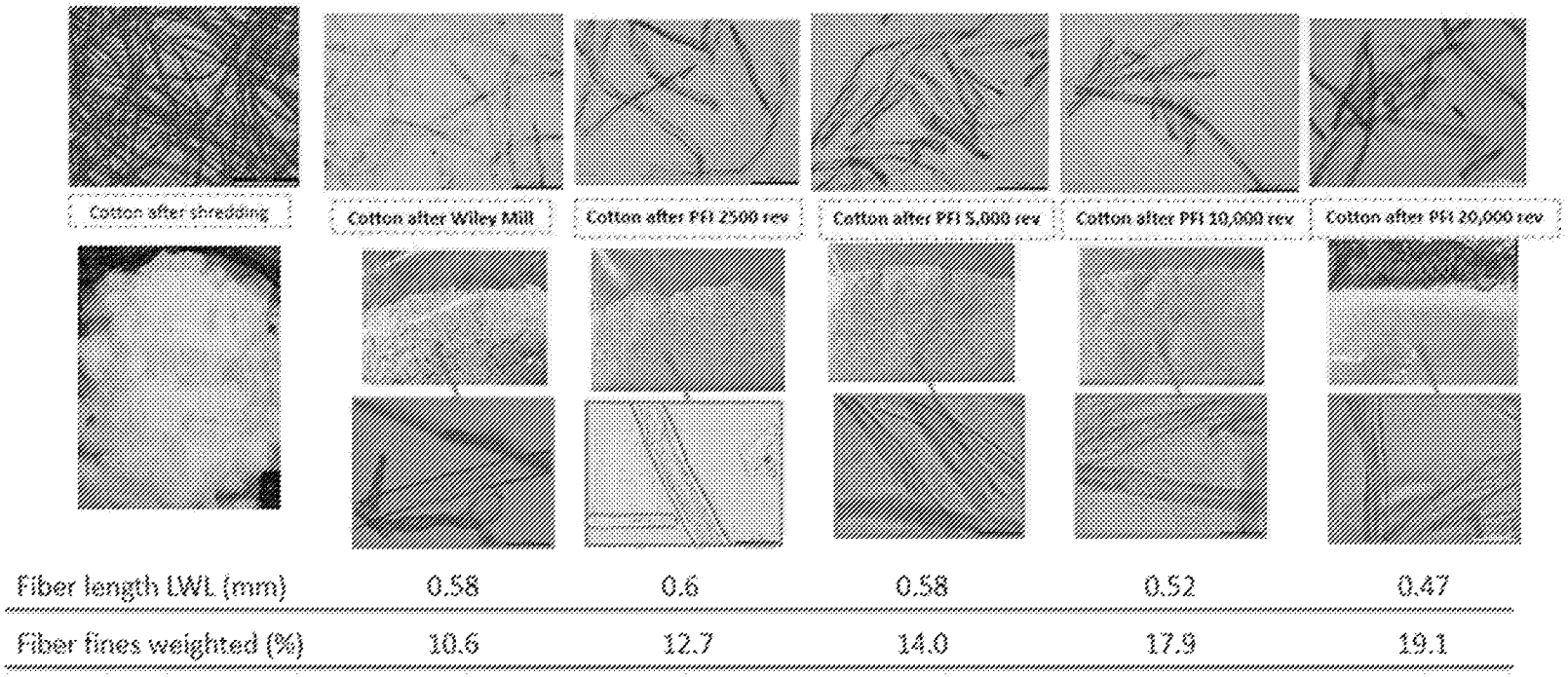
FIG. 1 depicts the cotton fibers after mechanical refining, (A) Shredding, (B) Wiley Mill; (C) PFI 2500 rev; (D) PFI 5,000 rev; (E) PFI 10,000 rev; and (F) PFI 20,000 rev. Included below are the fiber length LWL (mm) and the percentage of fiber fines weighted.

The processes of the present disclosure obtain high sugar yields from cotton-containing textiles comprising mechanical pretreatment in a PFI mill to refine the cotton-containing textiles.

Cotton textile waste from fabric has been found to be a promising biomass for the production of bioethanol as a renewable fuel source. According to this disclosure, cotton textiles, such as "trash" feedstock in terms of end-of-life-cotton textiles, may be used to produce sugar without the same kinds of harsh pretreatments used for other biomasses, such as corn, grass sources, or wood. It is known that cotton has higher crystallinity (than such other biomasses), which makes obtaining very high yields of sugar from cotton very challenging. The inventors surprisingly discovered that, despite having higher crystallinity, cotton in the form of cotton textiles can be used to obtain high yields of sugar using the methods described herein.

The methods described herein provide for more efficient pre-treatment of cotton textile containing waste, wherein the cotton fibers produced by the pretreatment have shorter fiber length, a greater percentage of fines by weight, and more disrupted cellulosic fibers. The leads to an unexpected improvement in the processing of the pretreated cotton textile containing waste into sugars, and downstream, into chemicals.

Definitions

In the following, some definitions of terms frequently used in this specification to characterize the invention are provided. These terms will, in each instance of its use, in the remainder of the specification have the respectively defined meaning and preferred meanings.

As used in this specification and the appended claims, the singular forms "a", "an", and "the" include plural referents, unless the content clearly dictates otherwise.

"Fines," as used herein, refers broadly to fibers that are small enough to pass through a mesh screen that has a perforation diameter of 76 μm and also contributes to the final properties of a product. Fischer et al. "Pulp Fines-Characterization, Sheet Formation, and Comparison to Microfibrillated Cellulose" *Polymers* 9 (366): 2017

"Fiber length LWL," as used herein, refers broadly to pulp term related to average length weighted length. "The Application of Fiber Quality Analysis (FQA) and Cellulose Accessibility Measurements To Better Elucidate the Impact of Fiber Curls and Kinks on the Enzymatic Hydrolysis of Fibers" Richard P. Chandra, Jie Wu, and Jack N. *Saddler ACS Sustainable Chemistry & Engineering* 2019 7 (9), 8827-8833.

Filter Paper Cellulase Activity (FPU)," as used herein, refers broadly to the amount of enzyme which produces 2.0 mg of released sugar from 50 mg of filter paper (Whatman No. 1) within 1 hour.

"Cotton-containing Textiles," as used herein, refers broadly to any textile containing cotton fibers.

"Textile cotton" or "recycled textile cotton," as used herein, refers broadly to a collected raw material (e.g., clothing at the end of its service life, scraps of fabrics from the garment industry, lint) that is a waste and the cotton component by nature is composed of more than 90% cellulose (which can be converted into sugar).

"Canadian Standard Freeness (CSF)" as used herein, refers broadly to mechanically pretreated cotton-containing textile material. Canadian Standard freeness (CSF) is directly related to the intensity of mechanical refining. It provides a measure of the rate at which a dilute suspension of pulp (e.g., cotton fibers) is dewatered under specified conditions. The dewatering ratio change proportionally inverse to the level of refining.

Textile Waste and Processing

Current methods to transform cellulosic textile waste into bio-based building blocks are few, and they are based on acid or alkaline chemical usage with yields between 40 and 90% under very aggressive conditions (high chemical charge). These proposed pathways are capital investment intensive, with high conversion cost, mainly related to the high chemical use, and with subsequent issues related to chemical recovery, resulting thus in high carbon and environmental footprint. Alvira et al. "Pretreatment technologies for an efficient bioethanol production process based on enzymatic hydrolysis: A review," *Bioresour. Technol.* (2010) 101 (13): 4851-4861. The development of a technology capable of converting recycled/used garments into bio-based building blocks that are sustainable and industrially feasible could represent an important contribution to the cotton and recycled waste business. Abbati De Assis et al., "Risk management consideration in the bioeconomy," *Biofuels, Bioprod. Biorefining* (2017) 11:549-566.

Because of the aggressive pretreatment required to obtain sugar from cotton biomass (e.g., plant, stalk, gin trash), cotton has not been considered as a high value biomass feedstock. Additionally, cotton typically has a higher degree of crystallinity than other sources of cellulose that makes bioconversion even more challenging. O. J. Rojas, *Cellulose Chemistry and Properties: Fibers, Nanocelluloses and Advanced Materials.* 2016. However, cotton in the form of textiles is 90%+ pure cellulose (and subsequently glucose) that has already been processed and, at the end of life of the consumer good, is essentially a free feedstock for bioprocessing. If end-of-life cotton garments are utilized instead of biomass grown for use as a feedstock, an environmental benefit is obtained, in addition to economic benefits.

For production of sugar from cotton textiles, the of use exotic solvents, high levels of acids, or high levels of caustic at low temperatures have been barriers to commercialization. These processes are not commercially viable due to cost and additional materials needed to neutralize high levels of acid or caustic, recovering and recycling solvents along with the costs of the solvents, and for caustic, maintaining a temperature near freezing. In addition to neutralizing the acid or caustic, the neutralized component needs further to be rinsed.

Cellulose has been used for as a feedstock for ethanol and glucose production, via enzymatic hydrolysis and fermentation. Different pretreatment methods have been used to hinder the effect of hemicellulose and lignin on enzymatic hydrolysis, and therefore to make cellulose available to enzymes. In the case of cotton textile waste, cellulose is further available for enzymatic hydrolysis due to the very low content of hemicellulose and lignin residues. Therefore other issues must be addressed to increase the yield of glucose and ethanol production, e.g., cellulose crystallinity, degree of polymerization and fiber size, and porosity.

The enzymatic hydrolysis process has been used to degrade cellulose to glucose. However, in cotton textile waste, conversion of cellulose to glucose is slow unless fibers are subjected to some form of pretreatment, due to the high degree of crystallinity and small pore size, which generates difficulties in the availability of cellulose molecules to react with enzymes. Chandra et al., "Substrate pretreatment: The key to effective enzymatic hydrolysis of lignocellulosics?," *Adv. Biochem. Eng. Biotechnol.* (2007) 108:67-93. The availability of cellulose for enzymatic hydrolysis of cotton waste materials is a factor in increasing the yield of glucose and ethanol production. Among the physicochemical properties that influence the yield of glucose in enzymatic hydrolysis of cellulose are specific surface area and cellulose crystallinity and degree of polymerization.

The methods described herein efficiently disrupt the cellulose structure and permit accessibility of enzymes during hydrolysis (saccharification) of cellulose to produce sugars (e.g., glucose). No harsh pretreatment is required. The inventors found that processing unrefined cotton-containing textiles resulted in low cellulose conversion. The mechanical refining methods described herein resulted in the delamination and fibrillation of the cotton fiber in a PFI mill at 5,000 rev resulted in greater cellulose conversion and did not require the use of any chemicals. For example, using a PFI mill at 10,000 rev resulted in 84% conversion using (enzyme 5 FPU) and 90% conversion (enzyme 6 FPU). [unit of filter paper cellulase activity].

Cotton-Containing Textile

Cellulose is a natural polymer consisting of a linear chain of hundreds to thousands of D-glucose units linked by β-(1,4)-glycosidic bonds. Cellulose content varies according to the biomass source. Among natural fibers containing cellulose, cotton is the biomass that contains the highest percentage of cellulose; its lignin content is almost null, which presents an advantage in processing. Bajpai, "Pretreatment of Lignocellulosic Biomass," Springer, Singapore, (2016) pages 17-70; Singh and K. B. Satapathy, "Conversion of Lignocellulosic Biomass to Bioethanol: An Overview with a Focus on Pretreatment," *Int. J. Eng. Technol.*, vol. 15, pp. 17-43, 2018.

Cotton fibers have a primary wall, a secondary wall, and a central core or lumen. The width of cotton fiber varies between 12 and 20 μm wide. The average degree of polymerization of cotton ranges between 9,000 and 15,000 with an average crystallinity of 73; both of these values are very high in comparison with other lignocellulosic materials like wood pulp (DP=600-1,500 and Crystallinity=35) and viscose rayon (DP=250-450 and Crystallinity=60). O. J. Rojas, *Cellulose Chemistry and Properties: Fibers, Nanocelluloses and Advanced Materials.* 2016.

A typical composition for raw cotton fiber is shown in Table 1. Cotton contains approximately 90% or more cellulose. The non-cellulosic constituents of cotton include proteins, amino acids, and nitrogen-containing compounds, which are mainly in the cuticle and the lumen.

TABLE 1

Composition of Cotton Fibers

| Constituent | Typical (%) | Range (%) |
|---|---|---|
| Cellulose | 95 | 88.0-96.0 |
| Protein | 1.3 | 1.1-1.9 |
| Pectic substances | 0.9 | 0.7-1.2 |

TABLE 1-continued

Composition of Cotton Fibers

| Constituent | Typical (%) | Range (%) |
|---|---|---|
| Ash | 1.2 | 0.7-1.6 |
| Wax | 0.6 | 0.4-1.0 |
| Total sugars | 0.3 | 0.1-1.0 |
| Organic acids | 0.8 | 0.5-1.0 |
| Other | 1.4 | — |

Heinze et al, *Cellulose Chemistry and Properties: Fibers, Nanocelluloses and Advanced Materials*, vol. 271. Springer International Publishing, 2016.

The cotton-containing textiles processed by the methods described herein may comprise any cotton, cotton-blend garments, including, but not limited to, cotton-polyester blend garments, or mixtures thereof.

Mechanical Pretreatment

Mechanical pretreatment of the cotton-containing textile may comprise mechanical processes for breaking down the cotton-containing textile including but not limited to, grinding, shredding, cutting, milling, refining, chopping, or garneting. Mechanical pretreatment effectively physically breaks down the textile into smaller components, increases the surface area of the textile components, reduces crystallinity of the textile, or a combination thereof, aiding in subsequent hydrolysis.

The equipment commonly used for fiber size reduction includes mills, extruders and fibrillators. The effects of mechanical treatment are mainly achieved due to the high shear forces generated in grinding and milling processes. Fiber fractions of different sizes are accumulated in the largest particles (>0.1-2 mm), whereas fines increase with the intensity of shear stress in the treatment. Disk milling, which produces more defibrillation and delamination of fibers, has been proven more effective in enhancing cellulose hydrolysis than hammer milling. Grinding, milling, and refining require high energy input; hence they are cost-intensive, which is detrimental to their widescale application. Hendriks and G. Zeeman, "Pretreatments to enhance the digestibility of lignocellulosic biomass," *Bioresour. Technol.*, vol. 100, no. 1, pp. 10-18, January 2009.

Mechanical refining action consists of three mechanisms that change fiber structure and morphology: cutting (fiber length reduction), shearing (fiber surface fibrillation), and compression (fiber delamination). The mechanisms occur simultaneously but at different relative levels depending on the refining technology.

The length reduction of the fiber occurs due to the cutting action of the refiner plate as two refiner bars pass one another. Fibrillation is generally an external effect and involves the peeling of smaller fiber fragments away from the main fiber mass due to shearing forces. Lastly, delamination is generally an internal effect arising from repeated compression and decompression of fibers as they are squeezed between the bars and grooves of the refiner plates. The level of refining could be between about 5,000 and 20,000 PFI revolutions.

The impact of mechanical refining on fiber properties could maximize the reactivity of fibers towards enzymatic hydrolysis at lower energy consumption. Microscope image analysis has shown that refining causes separation of cells, surface fibrillation, internal delamination, and generation of fines. These changes collectively can contribute to an increase in the accessible surface area and a higher yield of enzymatic hydrolysis of cellulose (an increase in conversion by 10 to 30%).

Mechanical pretreatment may comprise breaking down the cotton-containing textile by shredding, cutting, milling, and then refining the cotton-containing textile material. Exemplary equipment include a ball mill or PFI Mill for milling, a Wiley Mill for cutting, and refiners such as a PFI refiner, a single disk refiner, a double disk refiner and a twin disk refiner.

A preferred mechanical pretreatment method comprises refining in a PFI mill, optionally at between about 5,000 and 20,000 PFI revolutions. The inventors surprisingly discovered that the use of PFI mill to refine the cotton-containing textile produced a pretreated material comprising more fines, smaller, more disrupted cellulose, yields unexpected improvement in results. For example, the cotton-containing textile may be milled in a PFI mill at about 5,000 PFI revolutions (rev), 6,000 rev, 7,000 rev, 8,000 rev, 9,000 rev, 10,000 rev, 11,000 rev, 12,000 rev, 13,000 rev, 14,000 rev, 15,000 rev, 16,000 rev, 17,000 rev, 18,000 rev, 19,000 rev, or 20,000 rev. The cotton-containing textile may be milled in a PFI mill at between about 5,000 PFI revolutions (rev) and 20,000 rev; 5,000 rev and 10,000 rev; 7,500 rev and 15,000 rev; 7,000 rev and 10,000 rev; 10,000 rev and 20,000 rev; 15,000 rev and 20,000 rev; or 17,500 rev and 20,000 rev.

A PFI mill is a machine developed by Papirindustriens Forskningsinstitut—The Norwegian Pulp and Paper Research Institute. It is known in the art as a PFI mill. The PFI mill is a beater featuring a high reproducibility, used for studying the relationship between beating degree of pulp and physical properties. This machine may be used in the preparation stage of paper making. Beating mechanism: a constant load is given to the pulp circulating in between stainless steel roll and cylindrical mill house, which are rotating with a constant difference in circumferential velocity, applying mechanical effects such as shear and compression, thereby performing beating by frictional forces between fibers. The number of rotations is read on the counter. The beating degree is evaluated by the freeness tester. The outcome of the refining is measured, compared and standardized by a property relate to dewatering also known as freeness where a quantitative scale is used, specifically Canadian Standard Freeness. See description number 0027. See also TAPPI (2000) Laboratory Beating of Pulp (PFI Mill Method). T 248 sp-00.

The mechanical pretreatment comprising milling in a PFI mill refines the cotton-containing textile, opening up the cotton fibers to allow better access for the enzymes during hydrolysis. Additionally, the inventors used HPLC analysis to provide a better analysis of the results and better develop the methods.

The mechanical pretreatment may comprises grinding the cotton-containing textile into a powder, optionally using a PFI mill, wherein average particle size of the powder is between about 0.10 mm and about 2.0 mm. The average particle size of the powder may be between about 0.15 mm and about 1.60 mm. The average particle size of the powder may be between about 0.20 mm and about 1.5 mm. The average particle size of the powder may be less than about 2.0 mm. The average particle size of the powder may be less than about 1.70 mm. For example, the average particle size of the powder may be greater than zero and less than about 0.10 mm, 0.20 mm, 0.30 mm, 0.40 mm, 0.50 mm, 0.60 mm, 0.70 mm, 0.80 mm, 0.90 mm, 1.0 mm, 1.1 mm, 1.2 mm, 1.3 mm, 1.4 mm, 1.5 mm, 1.6 mm, 1.7 mm, 1.8 mm, 1.9 mm, or 2.0 mm.

The inventors found that the mechanical refining action of a PFI mill yielded an unexpected improvement of pretreatment of the cotton-containing textile. The PFI mechanical refining action consists of three mechanisms that significantly change the fiber structure and morphology: cutting (fiber length reduction), shearing (fiber surface fibrillation), and compression (fiber delamination). These mechanisms occur simultaneously but at different relative levels depending on the refining technology. Chen et al. (2013) *Bioresour. Technol.* 147:401-408; Park et al. (2016) *Bioresour. Technol.* 199:59-67. The length reduction of the fiber occurs due to the cutting action of the refiner plate as two refiner bars pass one another. Excessive fiber cutting results in the generation of fines. Fibrillation is generally an external effect and involves peeling smaller fiber fragments away from the main fiber mass due to shearing forces. Lastly, delamination is generally an internal effect arising from repeated compression and decompression of fibers as they are squeezed between the bars and grooves of the refiner plates. Corbett et al. (2020) *Biotechnol. Bioeng.* 117:924-932; De Assis et al. (2018) *Biotechnol. Biofuels* 11. The forces involved in mechanical refining are described, for instance, in Gharehkani et al. (2015) *Carbohydr. Polym.* 115:785-803.

The method of the disclosure may be also used for a cotton-containing textile that is already mechanically pretreated. The cotton-containing textile may be ground, shredded, cut, chopped, garneted, or a combination thereof. The cotton-containing textile may be in the form of a powder.

The mechanical pretreatment may further comprise the addition of a solvent to the cotton-containing textile before, during or both before and during pretreatment. the solvent may be water. The amount of solvent added to the cotton-containing textile may be between about 1:0.01 and 1:30 mechanically pretreated cotton-containing textile in a weight/weight ratio. For a PFI mechanical refining process, the amount of solvent added to the cotton-containing textile may be 1:0.2. The amount of solvent added to the cotton-containing textile may be between about 1:0.1 and 1:20, 1:0.1 and 1:10, 1:0.1 and 1:5, or 1:0.1 and 1:0.5. The amount of solvent added to the cotton-containing textile may be about 1:0.1, 1:0.2, 1:0.3; 1:0.4. 1:0.5, 1:0.6, 1:0.7, 1:0.8, 1:0.9, or 1:1. For example, the PFI may be operated at about 5% solids (w/w) and 95% water (w/w). This may be expressed as 1:20 textile:solvent (water).

The temperature of the mechanical pretreatment could be conducted at a temperature between about 0° C. and 100° C.

The inventors surprisingly discovered that they did not need to use any chemicals in the pretreatment of the cotton-containing textile to achieve a very high cotton conversion rate. For example, previous studies used caustic chemicals, high thermal and enzyme expenditure to achieve cotton conversion.

| Substrate | Pretreatment Method | Optimum Pretreatment Condition | Enzyme | Yield | Polyester Recovery | Author |
|---|---|---|---|---|---|---|
| Blue jeans/cotton | Shredded and grounded/ NaOH | NaOH 12%, 0 C., 96 h | cellulase and b-glucosidase 20 FPU | 85.1% 24 h 99.1% 96 h | — — | (Jeihanipour & Taherzadeh, 2009) |
| 50/50 polyesFIG. 5ter/cotton | Shredded and grounded/ N-methyl morpholine-N-oxide (NMMO) | NMMO 85%, 120° C., 2 h | cellulase and b-glucosidase | 90% | — | (Jeihanipour et al., 2010) |
| 40/60 polyester/ viscose | Shredded and grounded/ N-methyl morpholine-N-oxide (NMMO) | NMMO 85%, 120° C., 2 h | cellulase and b-glucosidase | 90% | — | (Jeihanipour et al., 2010) |
| Blue jeans polyester/cotton | Milled/Phosphoric acid | $H_2PO_3$ 85%, 50° C., 7 h | cellulase and b-glucosidase 7.5 FPU | 79% | 100% | (Shen et al., 2013) |
| Blue jeans polyester/cotton | Milled/NaOH/Urea | NaOH 7% Urea 12%, -20° C., 1 h | cellulase and b-glucosidase | 70% | 98% | (Gholamzad et al., 2014) |
| 40/60 polyester/ cotton | Shredded/Pressure/ Sodium Carbonate | $Na_2CO_3$ 1M, 150° C. 72 h | cellulase and b-glucosidase | 48% | — | (Hasanzadeh et al., 2018) |
| Towel (87.7% cotton) | Steam Explosion | 5.5 Mpa, 271 ° C., 5 min | cellulase and meicelase | 42% | — | (Sasaki et al., 2019) |
| Towel (87.7% cotton) | Microwave | $H_2SO_4$ 1%, 180° C., 5 min | cellulase and meicelase | 80.70% | — | (Sasaki et al., 2019) |
| 60/40 polyester/ cotton | Milled/NaOH/Urea | NaOH 7%, Urea 12%, -20° C., 6 h | cellulase and b-glucosidase | 98% | — | (X. Li et al., 2019) |
| Medical cotton waste 95% cellulose | thermomechanical + H2SO4 | 22.5 mM H2SO4 0.22%, 180-220 C., 20-40 min | cellulase and b-glucosidase CTEC2 20 mg/g biomass | 95.2% | — | (Giakoumakis et al., 2020) |

In summary, the previous studies relied on high temperatures, large amounts of enzymes, harsh chemicals, and mixtures thereof, to achieve the cotton conversion. In contrast, the methods described herein do not rely on high temperatures, large amounts of enzymes, harsh chemicals, and mixtures thereof, to achieve the cotton conversion. For example, the inventors found that pretreatment with milling in a Wiley Mill followed by refining in a PFI mill at 10,00 revolutions and hydrolysis for 96 hours with wither 5 FPU or 6 FPU, yield 84% conversion or 90% conversion, respectfully. (5 FPU=4.4% g enzyme/g cotton and 6 FPU=5.1% g enzyme/g cotton).

For example, the cotton-containing textile may be shredded, cut, milled, and then have water added, and be reined in a PFI mill at between about 5,000 rev and 20,000 rev. Following this, the pretreated cotton-containing textile material is subjected to hydrolysis, using, for example, either 5 FPU or 6 FPU. This yields over 80% conversion of the cotton fibers and the only chemical used is acetic acid or citric acid during the enzymatic hydrolysis steps for pH control. No chemicals are used in the mechanical pretreatment steps. The only solvent used in the mechanical pretreatment step is water.

Decolorization

If the cotton-containing textile is a color other than bleached cotton, dyed or printed, or if it has a finish applied to it such as but not limited to a softener, durable press resin, moisture resistant/moisture wicking finish, abrasion resistant finish, antimicrobial finish or flame retardant finish, enzymatic hydrolysis performance is reduced. See Buschle-Diller & Traore (1998). Influence of direct and reactive dyes on the enzymatic hydrolysis of cotton. *Textile Research Journal,* 68 (3), 185-192.

Then the cotton-containing textile may be decolorized to remove dyes or finishes prior to the pretreatment, hydrolysis and/or saccharification. The dyed or finished cotton-containing textile may be subjected to a decolorization process to remove dye and or finished that may interfere with the enzymatic hydrolysis. The inventors surprisingly discovered that the decolorization methods described herein allow for decolorizing without downstream interference with the enzymes used in hydrolysis and saccharification. For example, decolorization using the methods described herein increased the yield from about 40% to about 80% to 90%. For example, the cotton-containing textile may be decolorized after cutting and milling but before mechanical refining.

The decolorization treatment may comprise removing part of all of the dye or exposing cellulose of the cotton-containing textile to the hydrolyzing materials. The decolorization method may comprise using at least one bleach compound. The bleach compound may be ozone, sodium hypochlorite, hydrogen peroxide, Fenton's reagent, or a combination thereof.

The bleach compound may be hydrogen peroxide. The cotton-containing material may be bleached with hydrogen peroxide in a range from about 1.0% to about 8.0%, optionally in a range from about 2.0% to 6.0%. The hydrogen peroxide may be combined with sodium hydroxide, the sodium hydroxide may be a range from 1.0% to about 6.0%, optionally in a range from 2.0% to 4.0%. The hydrogen and sodium peroxide may be further combined with metals such as $Fe^{2+}$ and $Cu^{2+}$ in the range of 100 ppm to 250 ppm, optionally in a range from 120 ppm to 170 ppm. In the process, cotton content measured by percentage (%) from the total mixture can be in a range between 1% and 20%.

The decolorization temperature is preferably at a temperature range of 60° C. to 120° C., optionally in a range of 80° C. to 100° C. for time in a range of 60 minutes to 120 minutes, optionally in a range of 80 minutes to 110 minutes in a pH range preferably above 10. For example, the pH range may be between about 9 and 11.

The bleaching compound may be ozone. The ozone pretreatment procedure is disclosed, for example "Kinetics of ozone bleaching of eucalyptus kraft pulp and factors affecting the properties of the bleached pulp," BioRes. 13(1), 425-436. The cotton-containing material is bleached with ozone in a range from about 1.0% to about 20.0% wt, optionally in a range from about 2.0% to 10.0%, at a flow rate in the range from about 0.1 L/min to 20 L/min, optionally in a range from about 0.5 L/min to 10 L/min, or optionally in a range from about 1 L/min to 5 L/min. The ozone flow rate is 0.1 L/min, 0.2 L/min, 0.3 L/min, 0.4

L/min, 0.5 L/min, 0.6 L/min, 0.7 L/min, 0.8 L/min, 0.9 L/min, 1 L/min, 1.1 L/min, 1.2 L/min, 1.2 L/min, 1.3 L/min, 1.3 L/min, 1.4 L/min, 1.5 L/min, 1.6 L/min, 1.7 L/min, 1.8 L/min, 1.9 L/min, or 2 L/min. The ozone decolorization time range is in a range of about 1 minute to 60 minutes, optionally in a range of 10 minutes to 30 minutes. In a preferred embodiment, the range is 10 minutes, 12 minutes, 14 minutes, 16 minutes, 18 minutes, 20 minutes, 22 minutes, 24 minutes, 26 minutes, 28 minutes, or 30 minutes. The ozone decolorization in a pH range preferably from 2 to 11, optionally in a range from 3 to 11. The pH may be 3, 7 or 11. In the process, cotton content measured by percentage (%) from the total mixture can range between 1-30%.

In an embodiment, neutralization is carried out after bleaching pretreatment. Neutralization is carried out with Sulfuric acid until pH 7. Then, a washing process with water is performed at room temperature.

Acid Pretreatment Cooling Neutralizing

The cotton-containing textile may be, optionally, subjected to an acid pretreatment. The acid pretreatment of step (c) comprises at least one acid. The at least one acid may comprise a weak acid. Examples of weak acids include, but are not limited to, phosphoric acid, citric acid, nitrous acid, lactic acid, benzoic acid, acetic acid, and carbonic acid. In an embodiment, in contrast to strong acids, the weak acids are acids known to not completely dissociate in water. The at least one acid used in the acid pretreatment may comprise phosphoric acid. The concentration of the at least one acid in step (c) is between about 0.01 M and about 0.5 M, optionally between about 0.10 M and about 0.25 M, optionally between about 0.15 M and about 0.20 M.

The at least one acid is added to the powder at a liquor ratio in a range from about 2:1 to about 12:1, optionally in a range from about 4:1 to about 10:1, optionally at about 6:1.

Optionally, step (c) does not comprise addition of a base—i.e., a base is not used in pre-treating the cotton-containing textile. In an embodiment, step (c) does not comprise a pretreatment that requires neutralization from use of a strong acid or base, recovery of any solvent or pretreatment aids, or rinsing steps necessitated from a pretreatment that requires components to be removed before hydrolysis and/or fermentation.

The elevated temperature in step (c) may be in a range from about 115° C. to about 210° C., optionally in a range from about 121° C. to about 137° C., optionally in a range from about 126° C. to about 132° F., optionally at about 130° C. Heating time in step (c) is in a range from about 0.5 to about 5 hours, optionally from about 1 to about 3 hours, optionally about 2 hours. Agitators may optionally be added to the slurry to enhance internal mixing of the slurry. Due to the acid pretreatment, the resulting slurry has a much-lowered viscosity.

Step (c) may comprise cooling the slurry to a temperature in a range from about 48° C. to about 71° C., optionally in a range from about 54° C. to about 65° C., optionally at about 60° C.

Step (e) may comprise of adding at least one base to the slurry from (c) and optionally agitating the slurry. The at least one base may comprise a strong base. Examples of strong bases include, but are not limited to, potassium hydroxide, sodium hydroxide, barium hydroxide, cesium hydroxide, strontium hydroxide, lithium hydroxide, and rubidium hydroxide. The at least one strong base used in step (e) may comprise sodium hydroxide. The concentration of sodium hydroxide may be in a range from about 0.01 M to about 0.5 M. The concentration of sodium hydroxide is sufficient to effectively neutralize the acid previously added. The presence of sodium hydroxide neutralizes phosphoric acid to form sodium phosphate in situ. The slurry is then optionally agitated, optionally between 1 and 120 minutes, and at a temperature in a range from about 48° C. to about 70° C., optionally in a range from about 55° C. to about 65° C., optionally at about 60° C.

Step (e) may comprise adding at least one additional acid to the cotton slurry from step (d) to form a buffer in situ and optionally agitating the slurry. The at least one additional acid used in step (e) may comprise a weak acid. Examples of weak acids include, but are not limited to, phosphoric acid, citric acid, nitrous acid, lactic acid, benzoic acid, acetic acid, and carbonic acid. The weak acids do not completely dissociate in water. The at least one additional acid used in step (e) may comprise citric acid.

The citric acid from step (e) may form a buffer with sodium phosphate from step (d). A citric acid and sodium phosphate buffer is known as a McIlvaine buffer.

The concentration of the at least one acid in step (e) is between about 0.001 M and about 1.0 M, optionally between about 0.010 M and about 0.1 M, optionally between about 0.025 M and about 0.050 M.

Saccharification

The pretreated material may be subjected to enzymatic hydrolysis to produce sugars (Saccharification). For example, the pretreated material may be subjected to separate hydrolysis and fermentation (SHF), simultaneous saccharification and fermentation (SSF), or direct microbial conversion (DMC). Wyman et al. (1992) Biomass and Bioenergy 3 (5): 301-307.

The sugars produced by the methods described herein include but are not limited to glucan, xylan, arabinan, mannan, galactan, glucose, sucrose, hexose, and combinations thereof. The enzymatic hydrolysis may comprise incubation with a cellulase composition comprising one or more enzymes that hydrolyze a cellulosic material. Cellulase enzymes include but are not limited to endocellulases, exocellulases, cellobiases, oxidative cellulases, and endoglucanases. Other enzymes that may be used include but are not limited to cellobiohydrolases, beta-glycosidases, and combinations thereof. The hydrolysis may further comprise filtering, whereby the hydrolysate is fermented and saccharified to produce ethanol. Alternatively, if filtering does not occur, the hydrolysis may comprise fermenting and saccharifying the slurry from to form ethanol.

The same step may comprise fermenting and saccharifying the hydrolysate, or when the step comprises fermenting and saccharifying the slurry, the prior step may further comprise combining the hydrolysis enzyme with yeast.

The saccharification may comprise adding at least one hydrolytic enzyme, e.g., at least one cellulase, to the pretreated cotton material to initiate enzymatic hydrolysis of the pretreated cotton material to form a slurry, and optionally agitating the slurry. The enzymatic hydrolysis may be carried out utilizing a cocktail combination of at least one cellulase and β-glucosidase. The enzyme mixtures may comprise hemicellulases, cellulases, endo-glucanases, exo-glucanases, and 1-.beta.-glucosidases. The cellulase may be cellobiohydrolase, endocellulase, exocellulase, cellobiase, endo-beta-1,4-glucanase, beta-1,4-glucanase, or mixtures thereof.

After the hydrolysis cocktail is added to the pretreated cotton material, hydrolysis occurs for between about 24 and about 240 hours, optionally for between about 48 and 216 hours. The hydrolysis may occur for between about 24 and 36 hours, 24 and 144 hours, 24 and 168 hours, or 48 and 216 hours. The hydrolysis may occur for about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, 200, 201, 202, 203, 204, 205, 206, 207, 208, 209, 210, 211, 212, 213, 214, 215, or 216 hours. The slurry may be agitated.

The temperature during hydrolysis may be in a range from about 20° C. to about 60° C., optionally in a range from about 40° C. to about 55° C., optionally at about 48° C. The temperature during hydrolysis may be about 30° C., about which temperature saccharification and fermentation may occur simultaneously.

The pH of the enzyme solution during hydrolysis can be controlled with an acid or base or both for pH control. The pH during hydrolysis may be chosen by the skilled person and may be between 3.0 and 10.0, optionally in a range from about 4.0 to about 8.0, optionally in a range from about 4.5 to about 6.5. The pH may range up to 3 pH units, or up to 5 pH units. The optimum pH may lie within the limits of pH 3.0 to 9.0, 3.5 to 8.5, 4.0 to 8.0, or 4.0 to 7.5. The pH may be about 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, or 6.5. For example, the pH may be about 5.2.

The hydrolysis time is 6 hours or more, 10 hours or more, 12 hours or more, 14 hours or more, 16 hours or more, 18 hours or more, 20 hours or more, 30 hours or more, 40 hours or more, 50 hours or more, 60 hours or more, 70 hours or more, 80 hours or more, 90 hours or more, 100 hours or more, 110 hours or more, 120 hours or more, 130 hours or more, 140 hours or more, 150 hours or more, 160 hours or more, 170 hours or more, 180 hours or more, 190 hours or more, or 200 hours or more. The hydrolysis time is 10 to 120 hours.

The activity of the enzyme should be measured between 1 FPU and 540 FPU/g cotton. Developed by the IUPAC, an FPU is a standard way to express enzyme dosage and its ability to convert 50 g of cellulose filter paper into 2.0 mg glucose in 60 minutes. Adney, B. and Baker, J. "Measurements of Cellulase Activities," *NREL Laboratory Technical Report* NREL/TP-510-42628, 2008.

The amount of enzyme to cotton weight ratio ISE between 0.01% and 10.0%.

The hydrolysis efficiency may be determined in a manner known to one of skill in the art. Exemplary analysis methods include Cotton Residue, HPLC, and RIDA® Cube. In an embodiment, hydrolysis efficiency is determined using the RIDA® Cube method. The hydrolysis efficiency is at least about 10%, at least about 20%, at least about 30%, at least about 40%, at least about 50%, at least about 51%, at least about 52%, at least about 53%, at least about 54%, at least about 55%, at least about 56%, at least about 57%, at least about 58%, at least about 59%, at least about 60%, at least about 61%, at least about 62%, at least about 63%, at least about 64%, at least about 65%, at least about 66%, at least about 67%, at least about 68%, at least about 69%, at least about 70%, at least about 71%, at least about 72%, at least about 73%, at least about 74%, at least about 75%, at least about 76%, at least about 77%, at least about 78%, at least about 79%, or at least about 80%.

The methods described herein may not comprise a pretreatment step that requires neutralization from use of a strong acid or base, recovery of any solvent or pretreatment aids, or rinsing steps necessitated from a pretreatment that requires components to be removed before hydrolysis and/or fermentation.

Filtering and Drying

Following the hydrolysis step, the slurry may be filtered to produce a retentate (cotton residue) and a permeate (hydrolysate comprising sugars). This filtering may be done by any conventional means known to those skilled in the art, such as, for example, those described in U.S. Pat. No. 9,540,665, which is herein incorporated by reference. The cotton residue is then dried, for example in an oven, and optionally weighed after drying. The cotton residue is dried in an oven at a temperature in a range from about 48° C. to about 82° C., optionally in a range from about 60° C. to about 76° C., optionally at about 70° C. The drying time may optionally be at least about 2 hours, optionally in a range from about 4 to about 48 hours, optionally in a range from about 10 to about 24 hours, optionally at least about 16 hours.

After drying, a conversion rate (or hydrolysis efficiency) may be calculated. For example, after drying, the cotton residue may be weighed at time=0 minutes and time≥15 minutes. The conversion rate is then calculated based on the amount of cotton added and the weight of residue at time≥15 minutes. In an embodiment, HPLC and RIDA® Cube are analysis methods that may be used to measure glucose concentration of the solution to calculate the hydrolysis efficiency.

In another embodiment, cellulose conversion efficiency is calculated. The amount of cellulose in a garment is predetermined by an acid burnout. An HPLC is then performed to quantify the glucose in the hydrolyzed sample. The determined glucose is compared to the theoretical amount of glucose in the sample based on the following formula:

Cellulose conversion(%)=% cellulose converted into glucose/% initial cellulose in the system*100 (1)

Cellulose conversion(%)=(% glucose in HPLC)*0.9/[(% cotton in initial system)*cellulose content in cotton]*100 (2)

Where:

% cellulose converted into glucose=(% glucose in HPLC)*0.9 (3)

% initial cellulose in the system=(% cotton in the initial system)*cellulose content in cotton (4)*

(4)*Cellulose content in cotton is determined through compositional analysis using TAPPI and NREL standard method Conversion of Sugars to End Products The sugars produced by the methods described herein may further undergo biochemical treatment (e.g., fermentation) to produce end products. For example, the sugars produced by the methods described herein may be contacted with a microorganism in a fermentation process to produce end products. The sugars produced by the methods described herein may be contacted with an enzyme, or a mixture of enzymes, in a fermentation process to produce end products. The end products produced by fermentation, may include but are not limited to alcohols, acids (including fatty acids), gases, amino acids, chemicals, and mixtures thereof.

The alcohols that may be produced include but are not limited to ethanol, butanol, methanol, propanol, and mixtures thereof.

The acids that may be produced include but are not limited to 2,5-furandicarboxylic acid, itaconic acid, levulinic acid, succinic acid, lactic acid, malic acid, citric acid, acrylic acid, fumaric acid, hydroxypropionic acid, acrylic acid, and mixtures thereof.

The chemicals that may be produced include but are not limited to glycerol, 3-hydropropoionic acid, 2,5-dimethylfuran (DMF), 5-hydroxymethyl furfural (HMF), furfural, aldehydes, amines, terephthalic acid, hexamethylenediamine, isoprene, polyhydroxyalkanoates, 1,3-propanediol, or mixtures thereof.

The gases that may be produced include but are not limited to methane, ethane, CO, $CO_2$, $H_2$, or mixtures thereof.

EXAMPLES

Example 1

Enzymatic Hydrolysis of Cotton Textile

Cotton textiles were cut, milled, and then mechanically refined with a PFI mill at 5,000, 10,000, or 20,000 rev. A control was used of no refining. The pretreated cotton textile then underwent enzymatic hydrolysis at 50° C., pH=5.2, and an enzyme load up to 5 PFU/g cotton.

An FPU is a standard way to express enzyme dosage and its ability to convert 50 g of cellulose filter paper into 2.0 mg glucose in 60 minutes. Adney, B. and Baker, J. "Measurements of Cellulase Activities," *NREL Laboratory Technical Report* NREL/TP-510-42628, 2008.

Figure 2:
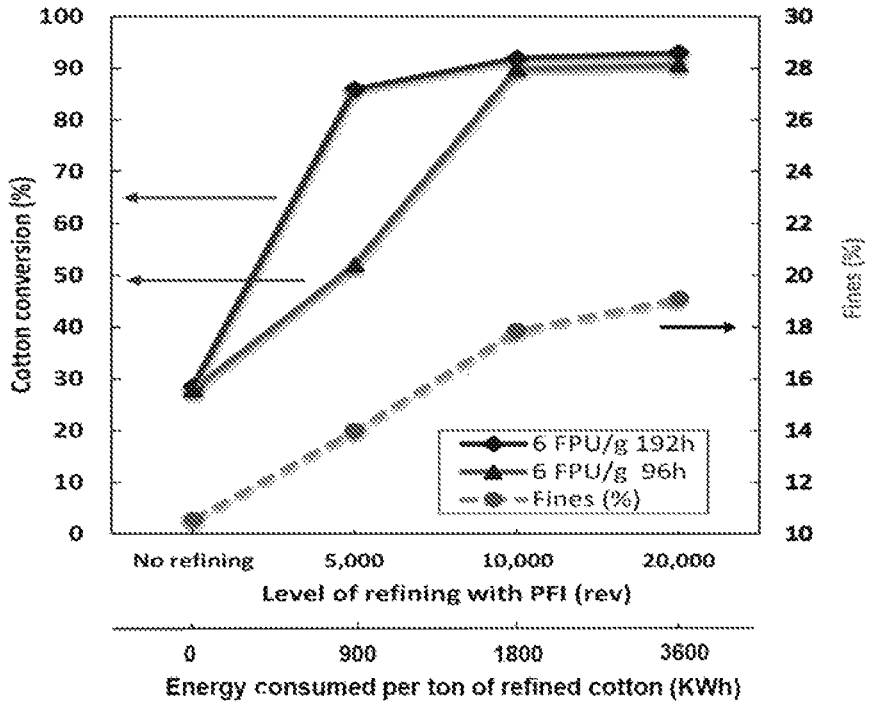
FIG. 2 depicts the enzymatic hydrolysis of cotton textile waste (50° C., pH=5.2, 6 FPU) for 96 hours versus 192 hours as compared to no refining. Cotton conversion (%) is shown on the left X-axis and percentage of fines on the right X axis. The level of refining with PFI as measured by (rev). Finally, the energy consumed per ton of cotton equivalent to each level of the refining is shown at the bottom. For example, 900 KWh would be needed to refine 1 ton of cotton at 5,000 PFI revs.
Figure 3:
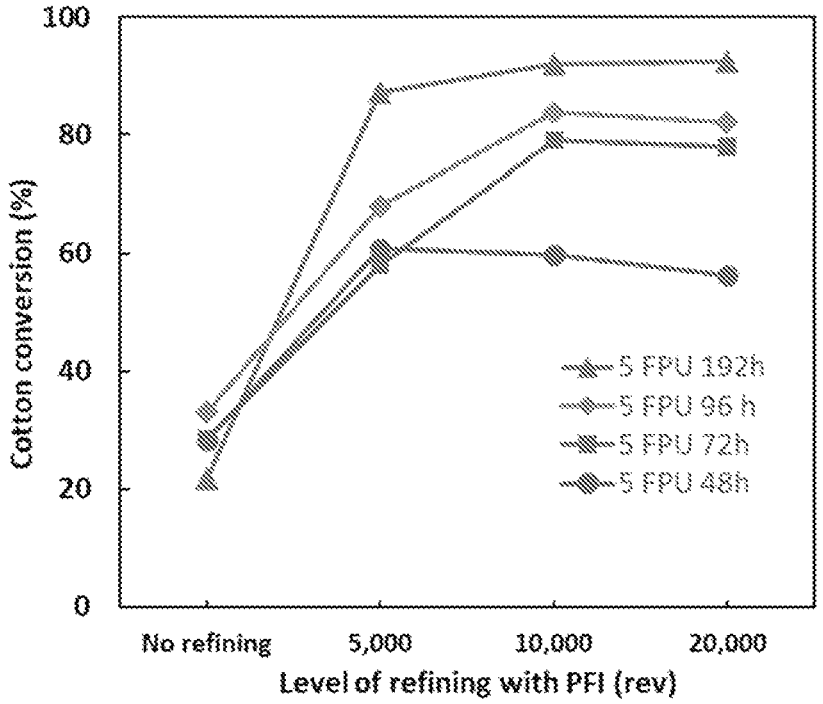
FIG. 3 depicts the cotton conversion (%) as a function of refining as measured by PFI revolutions. The enzymatic hydrolysis was carried out at 50° C., pH=5.2, 5 FPU for 48, 72, 96, or 192 hours. The efficiency of the cotton conversion as measured by percentage (%) based on initial mass of cotton increased with increased PFI revolutions.
Figure 4:
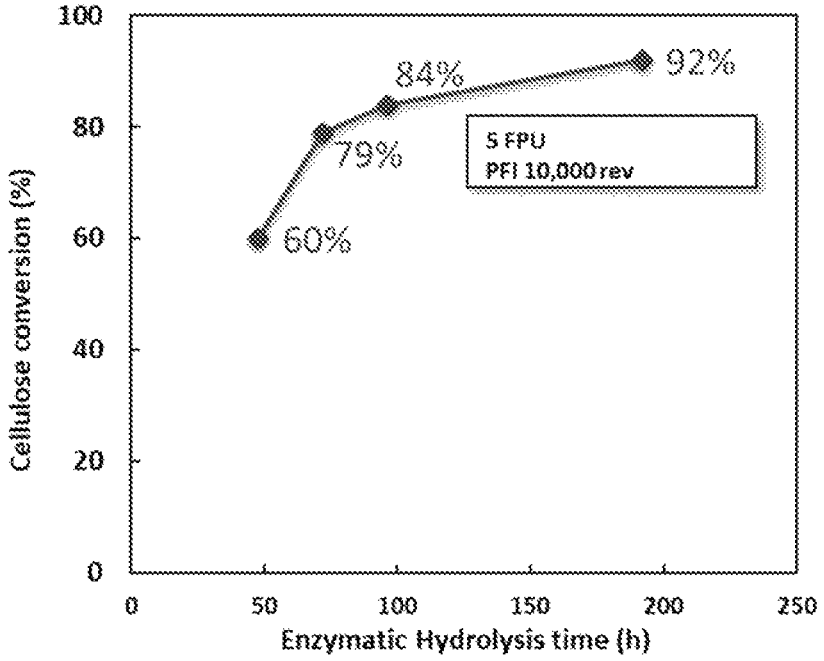
FIG. 4 depicts the cotton conversion (%) as a function of refining as measured by hours of reaction time. The enzymatic hydrolysis was carried out at 50° C., pH=5.2, 5 FPU. The efficiency of the cotton conversion as measured by percentage (%) based on initial mass of cotton increased with increased reaction time.
Figure 5:
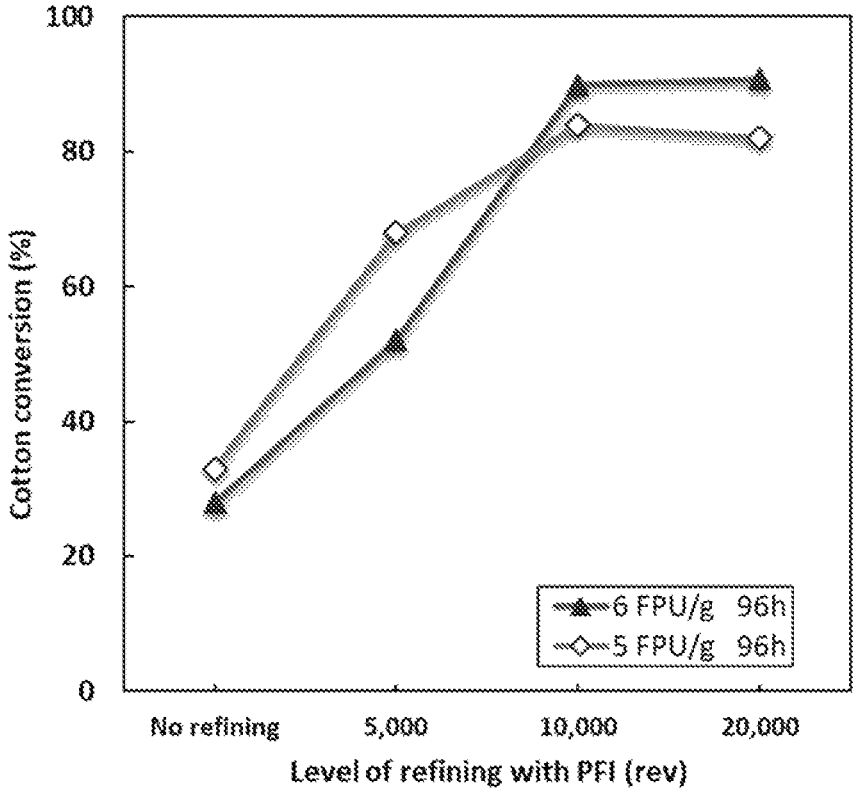
FIG. 5 depicts the cotton conversion (%) as a function of refining as measured by PFI revolutions. The enzymatic hydrolysis was carried out at 50° C., pH=5.2, 5 FPU (4.4% g enzyme/g OD cotton) or 6 FPU (5.1% g enzyme/g OD cotton) for 96 hours. The experiments were run in duplicate. The efficiency of the cotton conversion as measured by percentage (%) based on initial mass of cotton increased with increased PFI revolutions, with 6 FPU producing about 6% more cotton conversion that 5 FPU.
Figure 6:
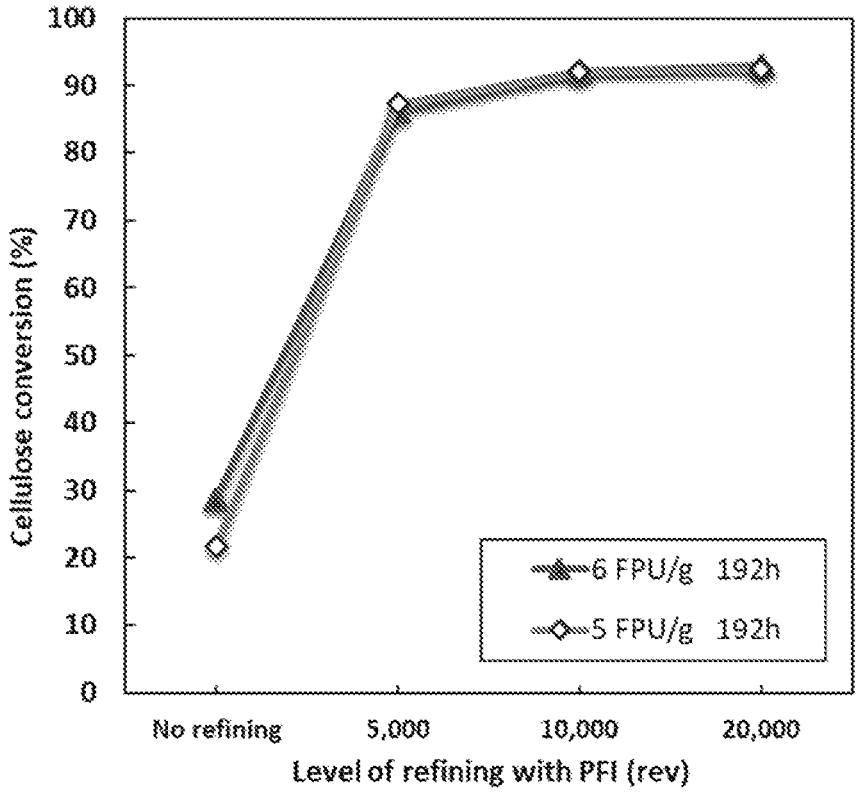
FIG. 6 depicts the cotton conversion (%) as a function of refining as measured by PFI revolutions. The enzymatic hydrolysis was carried out at 50° C., pH=5.2, 5 FPU (4.4% g enzyme/g OD cotton) or 6 FPU (5.1% g enzyme/g OD cotton) for 192 hours. The experiments were run in duplicate. The efficiency of the cotton conversion as measured by percentage (%) based on initial mass of cotton increased with increased PFI revolutions. Both reactions run at 5 FPU or 6 FPU produced reached 92% cotton conversion.

The inventors observed a surprising improvement in the efficiency of cotton conversion (e.g., fibers converted to sugars) with an increase in the intensive of the PFI pretreatment. The more intense PFI pretreatment resulted in shorter fiber lengths and increased percentage of fines by weight. The inventors found a yield increase of 60% from 28% with no refining (control) versus 90% with PFI pretreatment at 10,000 rev. FIG. 2. This demonstrates that the PFI pretreatment lead to an unexpected improvement in cotton textile hydrolysis. See also FIGS. 3-6. Enzymatic hydrolysis experiments were performed at different residence times (24, 48 and 96 h). In all of the cases, PFI mechanical refining highly improved cotton conversion.

The enzymatic hydrolysis experiments were performed at different enzyme charges, for example 4, 5, and 6 FPU/OD grams.

The enzymatic hydrolysis experiments were performed at 5% of cotton content (e.g., 5% of consistency or 5% (w/w) of solid content).

All publications (e.g., Non-Patent Literature), patents, patent application publications, and patent applications mentioned in this specification are indicative of the level of skill of those skilled in the art to which this invention pertains. All such publications (e.g., Non-Patent Literature), patents, patent application publications, and patent applications are herein incorporated by reference to the same extent as if each individual publication, patent, patent application publication, or patent application was specifically and individually indicated to be incorporated by reference.

The invention claimed is:

1. A method of pretreating cotton-containing textile material comprising refining the cotton-containing textile material in a PFI mill for between about 2,000 and 20,000 revolutions, wherein the method does not comprise a pretreatment step that requires neutralization from use of an acid or base, recovery of any solvent, or rinsing steps necessitated from a pretreatment that requires components to be removed before hydrolysis and/or fermentation.

2. The method of claim 1, wherein the method further comprises pretreatment comprising mechanical pretreatment, chemical, enzymatic pretreatment, or a combination thereof.

3. The method of claim 2, wherein the mechanical pretreatment is substantially free of the use of chemicals.

4. The method of claim 2, wherein the mechanically pretreated cotton-containing textile material comprises between about 1% and 50% fines by weight.

5. The method of claim 2, wherein the fiber length LWL (mm) of the mechanically pretreated cotton-containing textile material is between about 0.1 mm and 2.00 mm.

6. The method of claim 2, wherein the Canadian Standard Freeness (CSF) of mechanically pretreated cotton-containing textile material is between about 100 and 900 CSF milliliters.

7. The method of claim 2, wherein the mechanically pretreated cotton-containing textile is in the form of a powder.

8. The method of claim 2, wherein a Wiley Mill is used for the cutting step.

9. The method of claim 2, wherein the mechanical pretreatment is performed before decolorization of the cotton-containing textile material.

10. The method of claim 1, wherein the method further comprises shredding the cotton-containing textile material, cutting the cotton-containing textile material, and milling the cotton-containing textile material prior to refining the cotton-containing textile material in PFI mill.

11. The method of claim 1, wherein a solvent is added to the cotton-containing textile material prior to refining in a PFI mill.

12. The method of claim 11, wherein the solvent is water.

13. The method of claim 11, wherein the solvent is added before, during, or both before and during refining.

14. The method of claim 1, wherein the method further comprises enzymatic hydrolysis of the pretreated cotton-containing textile material to produce a hydrolysate.

15. The method of claim 1, wherein the method further comprises decolorizing the cotton-containing textile material.

16. The method of claim 15, wherein the decolorizing step comprises bleaching.

17. The method of claim 1, wherein the method further comprises adding $Cu^{2+}$.

18. The method of claim 1, wherein the method further comprises adding $Fe^{2+}$.

19. The method of claim 1, wherein the level of refining is between about 2,000 and 20,000 PFI revs.

20. The method of claim 1, wherein the method further comprises subjecting the pretreated cotton-containing textile material to hydrolysis to produce a hydrolysate.

21. The method of claim 20, wherein the hydrolysis comprises enzyme hydrolysis comprising the addition of at least one hydrolytic enzyme.

22. The method of claim 21, wherein the enzyme hydrolysis comprises the addition combination of a cellulase and a β-glucosidase.

23. The method of claim 20, wherein the method further comprises subjecting the hydrolysate to fermentation to produce an end product.

24. The method of claim 23, wherein the end product produced by fermentation comprises alcohols, sugar alcohols, acids, fatty acids, gases, amino acids, chemicals, and mixtures thereof.

25. The method of claim 1, wherein the method does not comprise a step that requires the use of an acid.

26. The method of claim 1, wherein the cotton-containing textiles comprise cotton, cotton-blend garments, cotton-polyester blend garments, or mixtures thereof.

27. A method of processing cotton-containing textile material comprising (a) shredding the cotton-containing textile material;

(b) cutting the cotton-containing textile material;

(c) milling the cotton-containing textile material;

(d) refining the cotton-containing textile material in a PFI mill for between about 2,000 and 20,000 revolutions; and (e) subjecting the cotton-containing textile material to hydrolysis to produce a hydrolysate, wherein the method does not comprise a pretreatment step that requires neutralization from use of an acid or base, recovery of any solvent, or rinsing steps necessitated from a pretreatment that requires components to be removed before hydrolysis and/or fermentation.

28. The method of claim 27, wherein the cotton-containing textiles comprise cotton, cotton-blend garments, cotton-polyester blend garments, or mixtures thereof.

* * * * *